United States Patent [19]

Yumoto

[11] Patent Number: 4,738,557

[45] Date of Patent: Apr. 19, 1988

[54] WRITING DEVICE WITH MULTIPLE WRITING ELEMENTS

[75] Inventor: Koichi Yumoto, Tokyo, Japan

[73] Assignee: Kabushiki Kaisha Japan Craft, Tokyo, Japan

[21] Appl. No.: 838,963

[22] Filed: Mar. 12, 1986

[30] Foreign Application Priority Data

Aug. 26, 1985 [JP] Japan ..... 60-186999

[51] Int. Cl.[4] ..... B43K 27/14; B43K 27/02; B43K 24/14

[52] U.S. Cl. ..... 401/29; 401/30; 401/109

[58] Field of Search ..... 401/29, 30, 32, 33, 401/17, 19-21, 16, 65

[56] References Cited

U.S. PATENT DOCUMENTS

| | | | |
|---|---|---|---|
| 2,826,173 | 3/1958 | Gossweiler et al. | 401/33 |
| 3,898,008 | 8/1975 | Ganz | 401/30 |
| 4,227,822 | 10/1980 | Kokubu | 401/17 |
| 4,283,151 | 8/1981 | Sekiguchi | 401/33 |
| 4,290,707 | 9/1981 | Ariga | 401/33 X |
| 4,359,291 | 11/1982 | Lum | 401/33 |

FOREIGN PATENT DOCUMENTS

| | | |
|---|---|---|
| 55-38280 | 10/1980 | Japan . |
| 57-50199 | 10/1982 | Japan . |

*Primary Examiner*—Richard J. Apley
*Assistant Examiner*—Franklin Gubernick
*Attorney, Agent, or Firm*—Armstrong, Nikaido, Marmelstein & Kubovcik

[57] ABSTRACT

A multi-purpose writing device comprising plural writing elements, at least one of which is an automatic pencil that can be extended, can be extended to and retracted from and between the writing position and the housed position alternately by rotating a cylindrical cam. The cylindrical cam is sectioned diagonally with respect to the axis at its lower end to form a cam surface and is also provided with a translation cam inside thereof to provide a two-stage cam mechanism. Further, a flat portion is made at the top and the bottom of the cam surface provided at the lower end of the cylinder member. A slider which connects with each writing element is stepped to provide slide projections while slide against the cam surfaces. The axial movement of the cylindrical cam is transmitted to the automatic pencil element by the engagement of the translation cam with the slide projections to cause the lead of the pencil to be discharged.

10 Claims, 3 Drawing Sheets

WRITING DEVICE WITH MULTIPLE WRITING ELEMENTS

BACKGROUND OF THE INVENTION

1. Field of the Invention

The present invention relates to a multi-purpose writing device which comprises a casing and plural writing elements contained in the casing, at least one of said writing elements being an automatic pencil that can be extended out of the casing.

2. Description of the Prior Art

Multi-purpose writing devices which respectively comprise a casing containing an automatic pencil and a ballpoint pen that can be extended out of the casing are know in the art. For example, there is known a writing device which comprises a guide cylinder containing an automatic pencil and a ballpoint pen in such a manner as to be axially slidable in directions different by 180° from each other. A cylindrical cam is provided around the guide cylinder in a circumferentially movable manner for a given angle and is adapted to cause the writing elements to extend and retract alternately along the axis by engaging with the writing elements and further is movable in the axial direction to extend the automatic pencil out.

Multi-purpose writing devices in which plural writing elements are alternately extended and retracted between a writing position and a housed position by means of such a cam mechanism are proposed, for example, in Japanese Patent Publication Nos. Sho 57-50199 and Sho 55-38280.

In a prior art multi-purpose writing device in which the writing elements are extended to and retracted from the writing position by the reciprocal rotational movement of the cylindrical cam and pressing the automatic pencil out, the slide projection of the slider of either the pencil or ballpoint slides and projects on the cam surface and engages with the tip of the cam surface to extend one of the writing elements out from an opening at the tip of the casing. Thus, when the automatic pencil element is pushed, the slider thereof is pressed by the tip of the cam surface and the lead of the pencil is discharged.

Writing devices using the prior art cam mechanism had the following defects. In order to reduce the diameter of a cap, it is necessary to mold the cylindrical cam with a reduced thickness. The cam surface has, however, a very narrow angled tip. When the cylindrical cam and the slider are molded of metal, they can be operated relatively stably. On the other had, if synthetic resin is used for molding these parts, the cylindrical cam becomes deformed when rotated and causes the slide projection of the slider to be displaced from the cam surface and caught in the cam, thereby preventing smooth movement of the cam.

Positioning of the writing elements also tends to become unstable as it is determined only by the engagement of the cam at its tip with the slide projection of the slider.

Moreover, cylindrical cams made of synthetic resin are easily worn, especially at the tip of the cam surface, making it difficult to achieve complete engagement with the slide projection of the slider at a predetermined position. As a result, alternate movements of the writing elements to and from the writing position become unstable and insecure. Discharging the lead of the automatic pencil also becomes difficult.

BRIEF SUMMARY OF THE INVENTION

The present invention has been contrived to overcome the above mentioned defects.

The present invention aims to provide a writing device which comprises plural writing elements capable of smooth extending and retracting operations to and from the writing position and which is capable of smoothly and securely discharging the lead of the automatic pencil.

Another object of the present invention is to provide an inexpensive writing device with plural writing elements by simplifying the overall construction to lower parts and assembly costs.

BRIEF DESCRIPTION OF THE DRAWINGS

The object and merits of the present invention as described above can be fully understood from the following description and the accompanying drawings.

In the drawings:

FIG. 2(A) a side view and FIG. 2(B) a perspective view thereof.

FIG. 3(A) a front view and FIG. 3(B) a perspective view thereof.

DESCRIPTION OF PREFERRED EMBODIMENT

Figure 1:
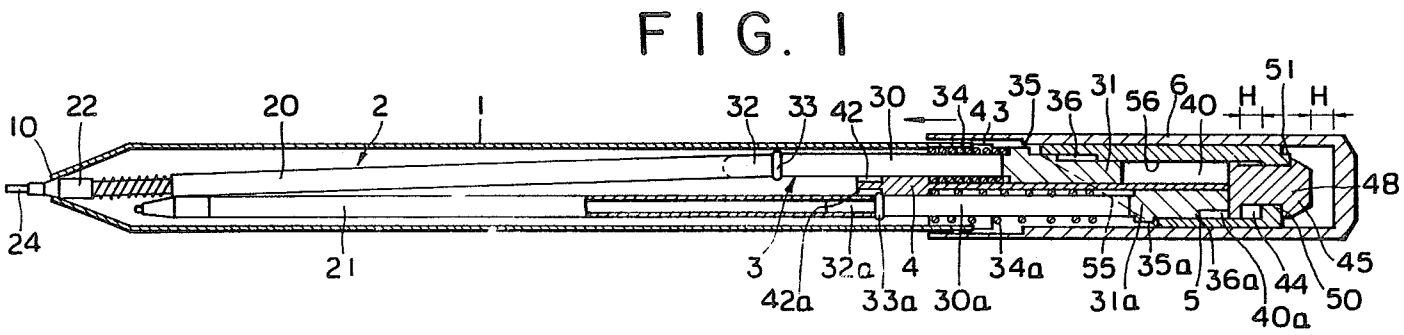
FIG. 1 is a vertical section of the device having an automatic pencil element at the writing position and a ballpoint pen element at the retracted position.

The present invention is constructed as follows to achieve the above mentioned objects.

The writing device according to the present invention comprises a casing 1 which houses plural writing elements 2, at least one of which being an automatic pencil of push-button type, rod 3 which connect the writing elements 2 to a guide cylinder 4 which moves the rod 3 slidably in the axial direction, a cylindrical cam 5 which is mounted on the outer periphery of the guide cylinder 4, and a cap 6 which is attached integrally to the cylindrical cam 5.

The casing 1 is tapered at the tip and has a tip opening 10. The writing elements 2 are housed inside the casing 1 with their tips directed toward the tip opening 10. The writing elements 2 include an automatic pencil element 20 and a ballpoint pen element 21, the automatic pencil 20 being shown in FIG. 1 as extended to the writing position and the ballpoint pen 21 being shown as retracted at the housed position. A mechanism 22 for discharging the lead such as a chuck and a clamping means is incorporated in the tip of the automatic pencil 20. The mechanism 22 for discharging the lead is retained inside the tip opening 10 and is pressed to expel lead 24. Explanation is omitted herein as the structure and function of the mechanism are known in the art.

The rear ends of the writing elements are connected to the rods 3 which is inserted in the guide cylinder 4 in a manner slidable only in the axial direction.

The guide cylinder 4 is securely fitted or screwed in an opening made at the other end of the casing 1. It may be possible to load the lead into the automatic pencil element 20 by removing the guide cylinder 4 from the casing 1. Alternatively still, it is possible to mold the casing 1 in halves to that the detachable halves may be opened for loading the lead.

The rods 3 include the rod 3A which connects with the automatic pencil element 20 and the rod 3B which connects with a ballpoint pen element 21.

Figure 2:
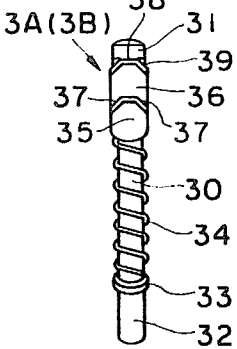
FIG. 2 shows a rod to be attached to the writing element.
Figure 2:
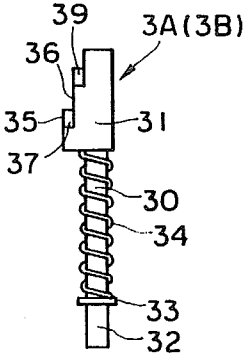
Figure 5A:
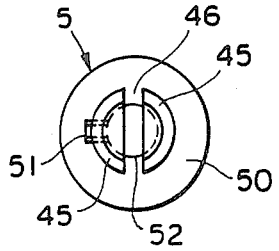
FIGS. 5(A), (B) are plan views to show the engagement between the rod and the cylindrical cam.
Figure 5B:
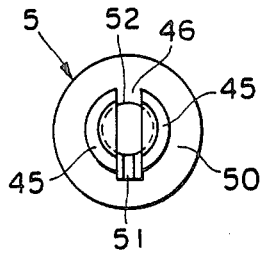

An explanation will be made of the rod 3A. As shown in FIG. 2, the rod 3A comprises the portion 30 where the coil spring is wound, the slider 31 and the portion 32 which is inserted in the writing element. A flange 33 projects between the portion 30 and the portion 32. The coil spring 34 is provided on the portion 30 to bias the rod 3A constantly toward the head of the guide cylinder 4 when the rod 3A is inserted to the guide cylinder 4.

The slider 31 is stepped to form slide projections 35 and 36 substantially in the form of a trapezoid. In other words, the slide projection 35 is located below the slide projection 36, with its side projecting farther than the side of the projection 36 and its upper surface being horizontal. A slanted surface 37 thereof is slidable against a cam surface of the cylindrical cam 5. On the other hand, the slide projection 36 has an upper surface which is provided with a notch 38 in the form of a letter U or V. Slanted surfaces 39 on both sides of the notch 38 become engaged to slide with another cam surface of the translation cam projected inside the cylindrical cam 5. The tip of the translation cam comes to engage with the notch 38 to stop its translations. (The cylindrical cam will be described later.)

Thus, while the slide projection 35 is made to substantially coincide with the outer surface of the cylindrical cam 5, the slide projection 36 is inscribed against the cam 5.

As the construction of rod 3B with the reference numerals **30*a*–39*a* is identical with the rod 3A**, explanation is omitted for simplification.

Figure 3:
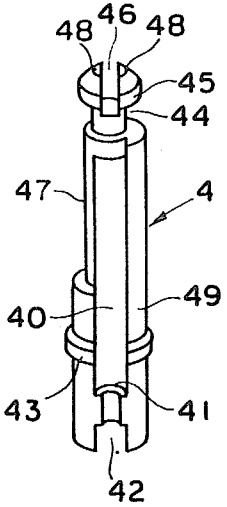
FIG. 3 shows a guide cylinder.
Figure 3:
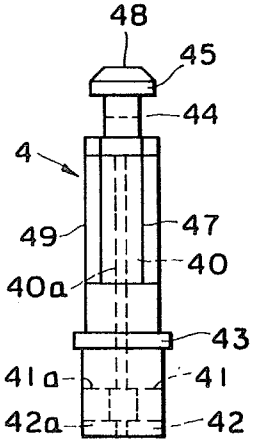

The guide cylinder 4 as shown in FIG. 3 is molded with synthetic resin. Guide grooves **40, 40*a* to guide the slider 31 along the axial direction are made on opposite sides of the guide cylinder 4 opposing each other at an angle of 180° in the direction of the diameter and extending in parallel with the axis of cylinder 4. The slider 31 or 31*a* of the rods 3A, 3B is inserted inside the corresponding guide groove 40 or 40*a*. The slider 31 or 31*a* is biased in the axial direction inside the guide groove 40 or 40*a* by the resilience of the coil springs 34, 34*a* provided around each portion 30, 30*a***.

Receiving portion 41 or **41*a* is formed at the lower part of the guide groove 40 or 40*a* in a smaller diameter to support the bottom end of the coil spring 34 or 34*a*. The bottom end of the coil spring 34 or 34*a* provided around the portions 30, 30*a* of the rod 3A or 3B is supported by the receiving portion 41, 41*a*. As the upper end of the coil spring 34 or 34*a* abuts against the slider 31 or 31*a* at the underside and the lower end being supported by the receiving portion 41 or 41*a*, the rods 3A and 3B remain constantly biased in the direction toward the head of the guide cylinder 4**.

Flange 33 or **33*a* of the rod 3A or 3B is inserted in the guide groove 42 or 42*a* at the lower end of the guide cylinder 4. The guide groove 40 or 40*a* and the guide groove 42 or 42*a* are coaxial. The guide grooves 42, 42*a*** may be omitted.

A collar 43 projects from the lower outer periphery of the guide cylinder 4. The collar 43 acts as a stopper which abuts against the rear end of the casing 1. As the casing 1 abuts against the collar 43, the casing 1 and the guide cylinder 4 are securely connected.

Further, the notch 47 is formed on one side of the guide cylinder 4 at its periphery 49, i.e. at the upper peripheral surface between the guide grooves 40 and **40*a*. The notch 47 acts as a guide for a translation cam 56 provided inside the cylindrical cam 5 which is described later and is therefore configured to accommodate the size of the translation cam. The notch 47 is provided on one side alone. Thus, when the cylindrical cam is rotated, the sides of the guide grooves 40, 40*a* act as a stopper for the translation cam provided inside the cylindrical cam 5. As the rod 3A or 3B is inserted in the guide groove 40 or 40*a*, the sliding projection 36 of the slider 31 projects farther than the plane of the notch 47 and the slide projection 35 projects farther than the peripheral surface 49**.

The stopper 45 is formed at the head of the guide cylinder 4 via a circumferential guide groove 44. The stopper 45 is divided into two elastic pieces 48 by a notched groove 46 having a depth reaching the guide groove 44. The guide groove 44 receives the stopper plate 50 of the cylindrical cam 5 and is formed with a sufficient length in the axial direction to enable the cylindrical cam 5 to move in the axial direction for discharging the lead of the automatic pencil 20. (see FIG. 1).

The rods 3 are inserted in the guide grooves **40, 40*a* of the guide cylinder 4 of the above construction. At the same time, the guide cylinder 4 itself is inserted inside the cylindrical cam 5** in a rotatable as well as axially slidable manner.

Figure 4:
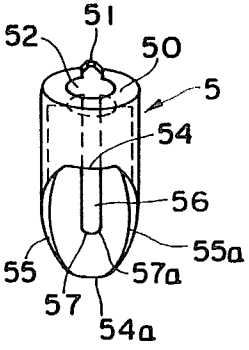
FIG. 4 is a perspective view of a cylindrical cam.

As shown in FIG. 4, the stopper plate 50 which engages with the guide groove 44 of the guide cylinder 4 is provided at the upper end of the cylindrical cam 5. A stopper projection 51 is projected on the upper surface of the stopper plate 50. The stopper projection 51 abuts against the stopper 45 of the guide cylinder 4 at its underside and is insertable in the end portion of the notched groove 46.

The guide cylinder 4 and the cylindrical cam 5 are assembled by snap-fitting the elastic pieces 48 of the guide cylinder 4 into a hole 52 made in the stopper plate 50 by utilizing the elastic deformation, and by engaging the stopper plate 50 with the guide groove 44. As the elastic pieces 48 are snap-fitted in the hole 52 of the stopper plate 50, the elastic pieces 48 immediately restore their original states and become parallel to each other. It is noted that the stopper projection 51 is so constructed that it abuts against the bottom surface of the stopper 45 and is insertable inside the notched groove 46 when the cylindrical cam 5 is turned.

As is evident from the drawings, the cylindrical cam is cut at the lower face diagonally with respect to the axis of the cylindrical cam 5 and has flat portions **54, 54*a* at the upper and lower ends respectively of the cut. Cam surfaces 55, 55*a* are symmetrically opposed on both sides of the flat portions. As the cam surfaces 55 and 55*a* merge at the lower end to form the flat portion 54*a* in the present invention, the flat portion 54*a*** does not come in contact with but stays apart from the slide projections 35, 35*a* of the sliders 31, 31*a* of the rods 3A, 3B when they reach the farthermost lower end.

Further, the translation cam 56 is projected inside the cylindrical cam 5 at a position above the flat portion 54*a*. The translation cam 56 has a width substantially the same or slightly greater than that of the flat portion 54*a* and projects downwardly like an arrowhead. Its cam surfaces 57, 57*a* become engaged with the slanted surfaces 39, 39*a* of the slide projections 36, 36*a* of the sliders 31, 31*a* for sliding.

In other words, given the width W of the translation cam 56 and the width $W_1$ of the flat portion 54*a*, it is expressed as $W \geqq W_1$. Given the distance L between the projections 35 and 36 and the distance $L_1$ between the upper end of the cam surface of the translation cam 56 and the flat portion 54*a*, it is expressed as $L = L_1$.

As the slanted surface 37 of the slide projection 35 of the slider 31 is caused to slide against the cam surfaces 55, 55*a* by turning the cylindrical cam 5, the slide projection 35 reaches the flat portion 54*a*. In the meantime, the cam surfaces 57, 57*a* of the translation cam 56 are caused to slide against the slanted surface 39 of the slide projection 36 immediately before the projection 35 reaches the flat portion 54*a*. As a result, when the tip of the translation cam 56 engages with the notch 38 and stops its translation, the projection 35 will be distanced from the flat portion 54*a* by the height l of the cam surfaces 57, 57*a* of the translation cam 56.

Therefore, when one of the writing elements is pressed down to the writing position, either one of the slide projections 36 or 36*a* of the slider 31 or 31*a* becomes engaged with the translation cam 56.

The cap 6 has a clip (not shown) at its side and is securely fitted over the outer surface of the cylindrical cam 5. At the bottom end of the cap is inserted the upper end of the casing 1 in a slidable manner.

As shown in FIG. 1, a space H each is provided between the cap 6 at its head and the elastic member 48 of the guide cylinder 4 and in the guide groove 44 in which the stopper plate 50 of the cylindrical cam is inserted so as to enable discharging of the lead of the automatic pencil 20. As the cylindrical cam 5 is made capable of reciprocal rotation for an angle of 180°, the cap 6 which is fitted over the cam 5 also reciprocally rotates for the angle of 180°. It can be moved for a given length in the axial direction as well.

Figure 6A:
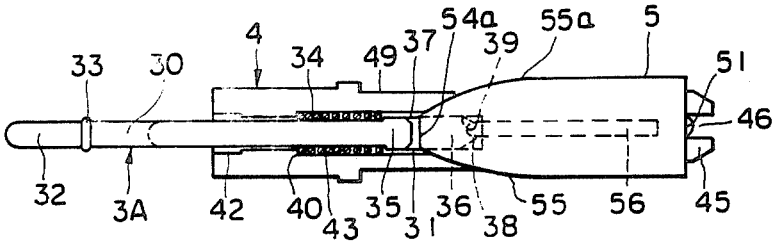
FIGS. 6(A), (B), (C) are sectional views of the essential parts showing the relative positions of the cylindrical cam when the writing elements are extended and retracted.

Referring now to FIGS. 6 and 7, the automatic pencil element 20 and the ballpoint pen element 21 will now be described with respect to their extending and retracting movements between the writing position and the housed position.

Figure 6B:
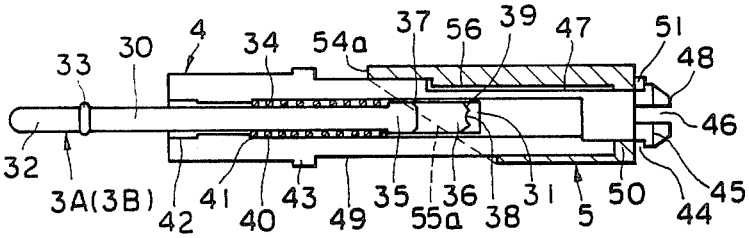
Figure 6C:
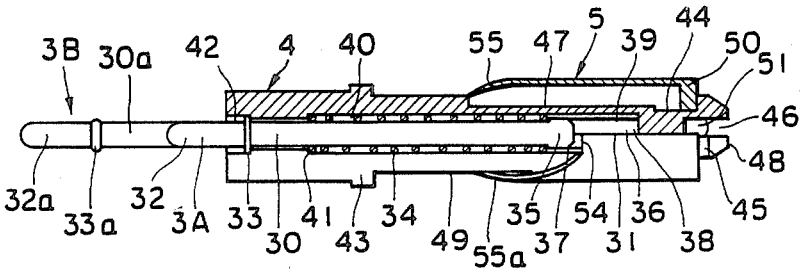
Figure 7A:
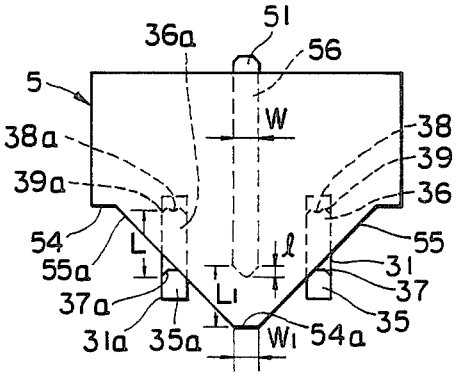
FIGS. 7(A), (B), (C) are views to explain the movements of the slider relative to the cylindrical cam at different stages.
Figure 7B:
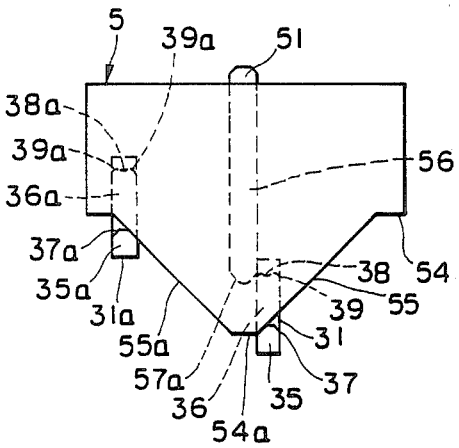

FIGS. 6(B) and 7(A) show the automatic pencil element 20 and the ballpoint pen element 21 in their retracted positions respectively inside the casing 1. In this state, the slider 31 of each of the rods 3A, 3B inserted in the guide grooves 40, 40*a* of the guide cylinder 4 is positioned substantially at a mid point in the cam surfaces 55, 55*a* by the pressure of the respective coil spring 34, 34*a*. At the same time, the respective slanted surface 37, 37*a* of the slide projections 35, 35*a* abuts against the cam surfaces 55, 55*a*, while the respective slanted surfaces 39, 39*a* of the slide projections 36, 36*a* are spaced apart from the cam surfaces 57, 57*a* of the translation cam 56.

On the other hand, the stopper projection 51 of the cylindrical cam 5 is disengaged from the notched groove 46 of the guide cylinder 4 and abuts against the underside of the stopper 45.

Figure 7C:
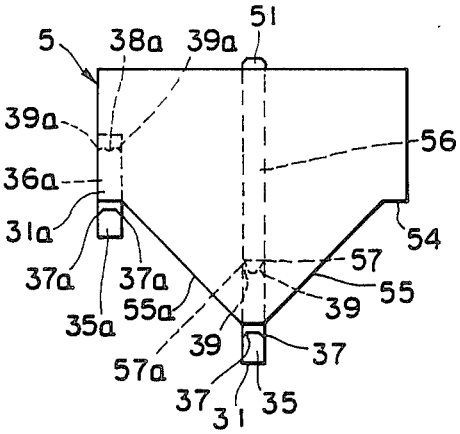

In order to cause the automatic pencil element 20 to extend to the writing position, the cap 6 is turned first. By turning the cap 6, the cylindrical cam 5 secured to the cap 6 is turned to assume the position as shown in FIGS. 6(A) and 7(C). As the cylindrical cam 5 is rotated, the slanted surface 37 of the slide projection 35 connected with the automatic pencil element 20 slides down along the cam surface 55, while the slanted surface 39 of the slide projection 35 abuts with and slides down along the cam surface 57 of the translation cam 56 just below where the cam surface 55 flattens into the flat portion 54*a* (see FIG. 7(B)). As the slide projection 36 reaches the farthermost lower end of the cam 56, the tip of the translation cam 56 becomes engaged with the notch 38 of the projection 36 and stops there.

When the tip of the translation cam 56 becomes engaged with the notch 38 of the slide projection 36 to cause the automatic pencil element 20 to extend to the writing position, the slide projection 35 is spaced from the flat portion 54*a* for a distance of l.

On the other hand, the slanted surfaces 37*a* of the slider 31*a* connected to the ballpoint pen element 21 slides up the cam surface 55*a*, and the upper surface of the slider 31*a* abuts against the upper surface of the guide groove 40*a* and the stopper flange 33*a* abuts against the upper surface of the guide groove 42*a* respectively just before the slanted surface 37*a* reaches the flat portion 54. Thus, the slanted surface 37*a* of the slider 31*a* is spaced apart from the cam surface 55*a* at a position below the flat portion 54 (see FIG. 6(C) and 7(C)).

As the cylindrical cam 5 is rotated, the stopper projection 51 of the cylindrical cam 5 slides on the underside of the stopper 45 of the guide cylinder 4 to be guided into the notch 46. As the stopper projection 51 engages with the notched groove 46 and the tip of the translation cam 56 fits into the notch 38 of the projection 36, the position of the writing element is securely determined. The click of this engagement also can be heard and this helps confirm that the writing elements are in their respective positions.

As mentioned above, since the stopper plate 50 of the cylindrical cam 5 abuts against the underside of the stopper 45 of the guide cylinder 4 by the pressing force of the coil springs 34, 34*a* and the stopper projection 51 is inserted in the notched groove 46, there will be made a space H, as shown in FIG. 1, when one of the writing elements is forwrded to the writing position.

Thus, when the cap 6, or the cylindrical cam 5, is pressed in the direction of the casing 1 (in the direction of the arrow), the movement is transmitted to the slider 31 via the slide projection 36 which engages with the translation cam 56 located inside the cylindrical cam 5 to result in discharging of the lead for the automatic pencil 20. The space H which is provided to allow the pressing is naturally configured and sized to permit discharging of the lead.

Instead of pressing the slider with the tip of the cylindrical cam 5 by pressing the cap 6 as in the prior art construction, the present invention is characterized in that the slider 31 is reciprocated by means of the translation cam 56 of a 2-stage cam construction for discharging the lead.

In order to forward the ballpoint pen element 21 to the writing position, the cylindrical cam 5 is rotated 180° (or 90° from the position indicated in FIGS. 6(B) and 7(A)). Explanation of relative movements of the automatic pencil element 20 and the ballpoint pen element 21 is omitted for simplification here as they are apparent from the foregoing description.

It is noted that although in the embodiment mentioned above, one of the writing elements is an automatic pencil and the other a ballpoint pen, both may be automatic pencils that can be extended.

By slanting the cam surfaces 55, 55*a* of the cylindrical cam 5 at a greater angle to increase the length of the flat portion 54, it becomes possible to provide three writing elements. It is necessary that in that case three guide grooves must be formed at an equal interval.

Although the cylindrical cam 5 of the present invention is made capable of reciprocal rotation for 180°, the notch 47 of the guide cylinder 4 may be formed around the entire circumference to allow rotation by 360°. By turning the cam in one direction alone, the writing elements can be extended and retracted.

The present invention having the above construction has the following concrete effects.

The writing elements are alternately extended and retracted by turning the cap 6 between the writing position and the housed position. Moreover, as the translation cam formed inside the cylindrical cam is pressed together with the cylindrical cam and as there is provided a space at the tip thereof, the writing elements can be extended/retracted smoothly and securely without causing deformation on the cylindrical cam.

As the slider 31 is pressed by the translation cam instead of the tip of the cylindrical cam for discharging the lead, the pushing operation becomes more stable.

As the stopper projection of the cylindrical cam becomes engaged in the notched groove 46 of the guide cylinder at its head, the writing elements can be securely positioned even if the cam is constructed to rotate 360°.

The relative positions of the writing elements can be readily selected and secured by the engagement of the stopper projection of the cylindrical cam with the notched groove 46 and that of the notched portions of the slide projections 36, 36*a* with the translation cam.

As the device according to the present invention is simple in construction, it requires less material and fewer steps in assembling and yet provides an inexpensive and trouble-free multi-purpose device.

It is readily apparent that the above-described multi-purpose writing device meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A writing device comprising:

a casing having an opening at its tip;

a guide cylinder provided with a plurality of axially extending guide grooves, a notch on the periphery of said guide cylinder and a circumferential guide groove adjacent to and defining a stopper at the head of said guide cylinder, said stopper having a groove extending transversely across the outer surface of said stopper and a notch at each end of said transverse groove, said guide cylinder being inserted in said casing at the end opposite said tip;

a plurality of rods and writing elements with each rod connected to a writing element and at least one writing element comprising an automatic pencil element, each rod being slidable in one of said plurality of guide grooves in said guide cylinder and having a stepped portion forming a pair of upper and lower slide projections adjacent one end thereof, means biasing each of said rods toward the head of said guide cylinder;

a cylindrical cam having an apertured stopper plate carried by said circumferential guide groove of said guide cylinder, said cylindrical cam being diagonally sectioned with respect to the axial direction to form a pair of cam surfaces, a flat portion formed at the top and at the bottom of the sectioned portion and a axially extending translation cam formed on the interior surface thereof above the lower flat surface, said stopper plate having a stopper projection which abuts against the underside of said circumferential guide groove and engages the notches at each end of said transverse groove; and a cap which is fixed to the cylindrical cam, wherein the writing elements are extended to and retracted from the writing position in an alternating manner in response to rotation of the cylindrical cam and axial movement of the cylindrical cam is transmitted to the automatic pencil element by engagement of the translation cam with the upper slide projection to cause the lead of the pencil to be discharged.

2. The writing device as claimed in claim 1 wherein the notched portion on the periphery of the cylinder is provided only on one side.

3. The writing device as claimed in claim 1 wherein the notched portion on the periphery of the cylinder is provided only on one side.

4. The writing device as claimed in claim 1 wherein the casing, guide cylinder, cylindrical cam and cap are molded out of synthetic resin.

5. The writing device as claimed in claim 2 wherein the casing, guide cylinder, cylindrical cam and cap are molded out of synthetic resin.

6. The writing device as claimed in claim 3 wherein the casing, guide cylinder, cylindrical cam and cap are molded out of synthetic resin.

7. The writing device as claimed in claim 1 wherein at least two of the writing elements are automatic pencils.

8. The writing device as claimed in claim 1 wherein at least two of the writing elements are automatic pencils.

9. The writing device as claimed in claim 2 wherein at least two of the writing elements are automatic pencils.

10. The writing device as claimed in claim 3 wherein at least two of the writing elements are automatic pencils.

* * * * *